United States Patent [19]

Kurzinski

[11] Patent Number: 4,494,594

[45] Date of Patent: Jan. 22, 1985

[54] SPRAY COOLING SYSTEM FOR CONTINUOUS STEEL CASTING MACHINE

[75] Inventor: Cass R. Kurzinski, Milford, Pa.

[73] Assignee: AMB Technology, Inc., New York, N.Y.

[21] Appl. No.: 299,999

[22] Filed: Sep. 8, 1981

[51] Int. Cl.[3] ..... B22D 11/124

[52] U.S. Cl. ..... 164/443; 164/418

[58] Field of Search ..... 164/443, 485, 418

[56] References Cited

U.S. PATENT DOCUMENTS

| | | | |
|---|---|---|---|
| 2,683,294 | 7/1954 | Ennor et al. | 164/488 |
| 2,698,467 | 1/1955 | Tarquinee et al. | 164/444 X |
| 2,747,244 | 5/1956 | Goss | 164/443 X |
| 2,752,648 | 7/1956 | Robert | 164/485 X |
| 2,837,791 | 6/1958 | Tessmann | 164/485 X |
| 3,388,737 | 6/1968 | Buckwalter et al. | 164/443 |

*Primary Examiner*—Nicholas P. Godici
*Assistant Examiner*—J. Reed Batten, Jr.
*Attorney, Agent, or Firm*—Dennis H. Lambert

[57] ABSTRACT

A mold tube is contained within an open water-cooling vessel, and the tube is cooled by directing water sprays at it. Although a steam barrier would otherwise form around the mold tube and prevent water penetration, thus resulting in a tube melt-down, this effect of the steam barrier is eliminated if certain operating parameters have values within critical ranges. The important parameters include the distance between the spray nozzles and the mold tube, the angle of each water spray, and the overlap of the sprays on the mold tube.

16 Claims, 7 Drawing Figures

SPRAY COOLING SYSTEM FOR CONTINUOUS STEEL CASTING MACHINE

This invention relates to high-temperature metal continuous casting machines, and more particularly to systems for cooling the machine mold with sprayed water.

In the conventional continuous steel casting method, molten steel is passed through a vertically-oriented, usually curved, copper mold (which is typically square-shaped, although it may be rectangular in the event steel slabs are to be made). As the molten steel passes through the mold its outer shell hardens. As the steel strand continues to harden, it is bent through an angle of 90° so that it moves horizontally, and it is subsequently cut into individual billets.

The temperature of molten steel is typically 2850° F., although with certain grades the temperature may be as low as 2600° F. In general, although most of the references herein are to steel casting, my invention contemplates the casting of any metal or metal alloy whose liquid temperature exceeds 2600° F.

The mold which forms the steel strand contains the liquid steel and provides for its initial solidification, that is, hardening of the outer shell. The solidifying strand is extracted continuously from the bottom of the mold at a rate equal to that of the incoming liquid steel at the top, the production rate being determined by the time required for the outer shell to harden sufficiently so as to contain the inner core of liquid steel by the time the mold is exited. The liquid steel is cooled in all present-day casting machines by providing a water system which circulates cooling water around the mold. The water enters at the bottom of a pressure-tight vessel which surrounds the mold and travels upward in a direction opposite to that of the moving liquid steel. The "counter-current" water flow has been found to be most efficient for heat transfer in continuous steel casting machines.

The cooling water is under high pressure and flows at a high velocity, for reasons to be described below. This necessitates that an enclosed, usually welded, pressure-tight vessel be employed. The copper mold is usually fixed to the pressure-tight vessel at both of its ends so that the cooling system is completely sealed. Should the mold melt at any point and the liquid steel contact the cooling water, a steam explosion results. Thus it is essential that sufficient heat be extracted from the liquid steel through the copper mold by the water flow.

A considerable amount of work has been done in the prior art and much is known about the heat transfer process which occurs in the above-described cooling system. As heat is transferred from the liquid steel to the flowing water through the walls of the copper mold, some of the water heats up to its boiling point. The resulting steam creates a barrier which prevents the continued flow of substantial quantities of heat through it from the copper mold to the cooling water. In order to increase the heat extraction rate and prevent the hot molten steel from melting through the copper mold tube, it is generally accepted by those knowledgeable in the field that the only reliable method of eliminating the steam barrier is to flow water at a high velocity along the face of the copper mold. It has been calculated and proven in operation that a linear velocity of 21–25 feet per second cooling water flowrate is necessary to result in turbulent flow conditions so as to effectively sweep the steam barrier from the copper tube/water interface.

From a practicality standpoint, this consideration further requires that the film thickness of the cooling water be typically 3/32 inch.

In the abandoned application of Kurzinski et al., Ser. No. 106,894, filed on Dec. 27, 1979 and entitled "Continuous Metal Casting Machine and Method", which application is hereby incorporated by reference, there is disclosed a continuous casting machine whose copper mold is secured to the surrounding frame only at the top. The bottom of the mold is not secured in the frame in order to facilitate mold replacement. Because the bottom of the mold is not secured to the frame, an enclosed pressure-tight cooling system cannot be provided around the mold tube. Instead, the mold is sprayed with jets of water, the water being collected at the bottom of the mold tube or even allowed to drip down along the strand.

The advantages of such a design will be apparent to those skilled in the art; mold tube changes are greatly facilitated and costs are reduced substantially. However, the system described in said application, when first tested, proved to be impractical, at least without the refinements to be described herein. A similar spray-cooling system was disclosed in Ennor et al. U.S. Pat. No. 2,683,294. But the Ennor et al system was designed for use with the casting of low-temperature metals. When the molten metal has a temperature of at least 2600° F., there is so much heat to be extracted that the Ennor et al system is ineffective and dangerous.

The problem is that some of the water spray turns to steam when it strikes the hot outer mold surface, and the steam serves as a barrier to substantially reduce the amount of water which penetrates it to the mold. It appeared from early experiments that the prior art high-pressure, turbulent water flow technique was essential to sweep the steam barrier away from the outer face of the hot copper tube.

It is a general object of my invention to provide a water spray system for cooling the mold tube in a continuous casting machine used to form strands of metal whose molten temperature exceeds 2600° F.

The advantages of an open mold-containing system, by using a water spray cooling technique, can be achieved only by carefully selecting certain critical parameters. It is to be noted that another object of the invention was to construct such a system which would allow conventional subsystems to be utilized, e.g., standard mold lengths (32" although longer or shorter mold lengths are equally feasible in accordance with my invention), standard water pumping rates (150–500 gallons per minute), etc. With the proper choice of critical parameters, it has proved feasible to have the incoming water spray partially disperse the steam barrier and also lower the surrounding steam temperature to condense it. It is by utilizing a unique set of certain critical operating variables that a water spray system can not only effectively result in a satisfactory heat transfer system, but accomplish the operation more efficiently than with the prior art flowing-film technique. As will become apparent below, the hardened strand shell is thicker at the exit end of the sprayed mold than it is in a comparable prior art system operated at the same rate. This means that the cast strand can even be extracted at a faster rate than in a comparable prior art system without any loss of quality or any increased danger to operating personnel.

Further objects, features and advantages of my invention will become apparent upon consideration of the following detailed description in conjunction with the drawing, in which.

Figure 1:
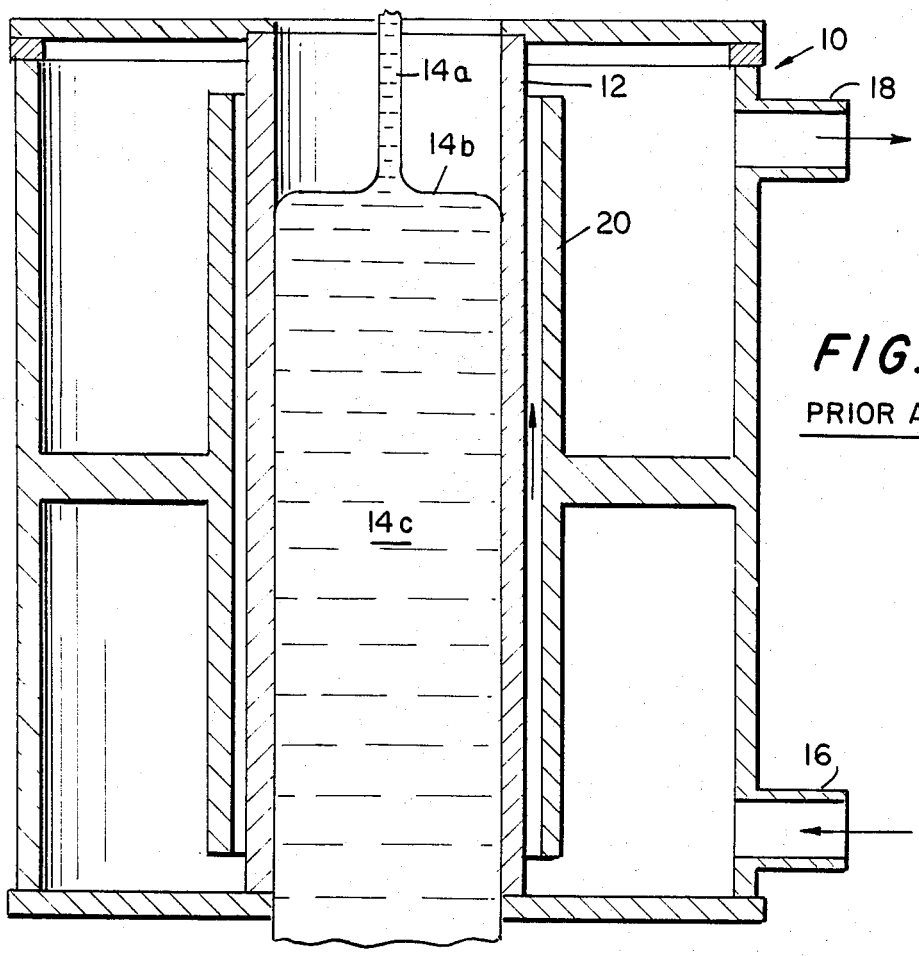
FIG. 1 PRIOR ART
FIG. 1 depicts symbolically a prior art mold and surrounding pressure-tight water cooling system.

FIG. 1 depicts a frame 10 in which a copper mold 12 is mounted at the top. The frame is made of A-36 steel, and the mold tube is made of DHP-grade copper. A thin stream of molten steel **14*a* is poured into the mold tube at a rate, relative to the rate of solidification and strand withdrawal, which positions meniscus 14*b*** in the upper region of the mold. Because the mold is fixed to the frame both at its top and its bottom, the frame and the tube form a pressure-tight vessel. (FIG. 1 does not depict those elements not necessary for an understanding of the present invention, for example, the mechanisms for pouring the molten steel into the mold, for extracting the solidifying strand, etc.)

Cold water enters inlet pipe 16 at the bottom, and heated water leaves outlet pipe 18 at the top. A baffle jacket 20 surrounds tube 12, and the piping within frame 10 (not shown) is such that a high-velocity film of water flows upward between the exterior surface of tube 12 and the interior surface of jacket 20. The spacing between the two surfaces is only 3/32"; the flow is turbulent so as to sweep away any steam which is formed. The heat extracted from the mold tube causes strand **14*c*** to solidify, the solidification progressing inwardly as the strand moves downwardly.

Heat extraction at the extreme top and bottom of the tube is minimal since baffle jacket 20 does not surround the top and bottom of the tube. However, relatively little heat must be extracted at the top and bottom of the tube, and thus there is much less of a chance of the tube melting at these two regions. At the top of the tube no molten steel is contained, and the temperature of the forming strand is considerably reduced at the bottom of the mold, typically at 2150° F.

Figure 2:
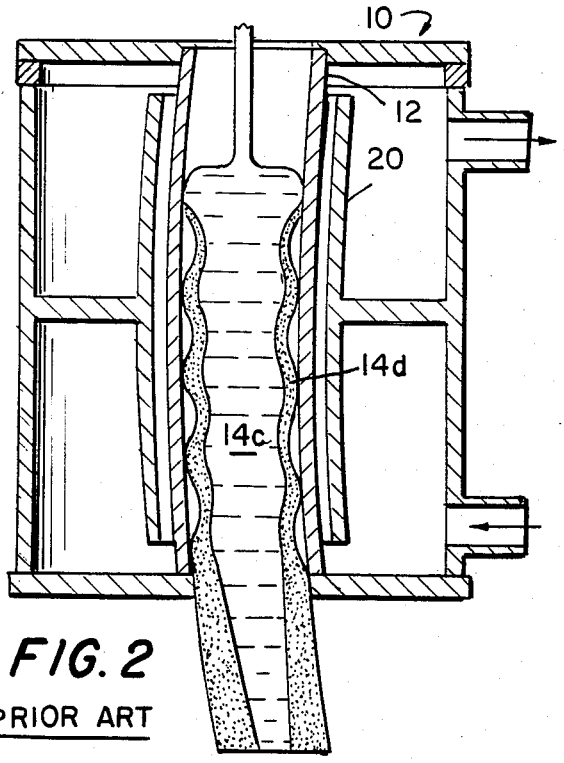
FIG. 2 PRIOR ART
FIG. 2 depicts the same prior art system and further shows, in exaggerated form, the manner in which the outer shell of the strand solidifies.

FIG. 2 depicts the manner in which the shell of the strand hardens as it is withdrawn from the bottom of the mold. (FIG. 2, unlike FIG. 1, also shows the use of a slightly curved mold as is conventional practice.) Incoming liquid steel first comes into contact with the cold copper mold and solidifies instantaneously, forming a thin shell surrounding the interior liquid core. The cooling effect of the circulating water causes the shell to contract and shrink away from the copper mold interior wall. There is thus less heat extracted from the liquid interior due to the loss of contact; the high temperature of the interior liquid steel causes the shell to expand and once again to come into contact with the wall of the mold. As soon as intimate contact is made once again, there is a further transfer of heat to the cooling water and once again the shell contracts away from the molding wall. The expansion and contraction continues as the strand is moved through the mold. FIG. 2 shows the hardening shell **14*d*** of the strand, the thickness of the shell increasing from top to bottom (and continuing to thicken following exit from the mold as additional cooling system, not shown, extract more heat until eventually the strand completely solidifies). As can be seen in FIG. 2, because of the expansion and contraction of the strand within the mold, the shell is not in continuous contact with the mold wall. Therefore, the rate of heat transfer is less than it otherwise would be, and this in turn results in a thinner shell at the exit and less support for the liquid core.

Because the probability of the liquid core remelting the outer shell and pouring out of the solidifying strand after mold exit is directly proportional to the shell thickness, the thinner the shell the greater the probability of a melt-through or breakout. The maximum casting speed is dependent upon the shell thickness at the mold exit since every section of steel must remain in the mold long enough for a sufficiently thick shell to be formed. Were it not for the expansion-contraction effect, the casting speed could be increased or, alternatively, for the same casting speed a thicker shell would be present at the mold exit.

Figure 3:
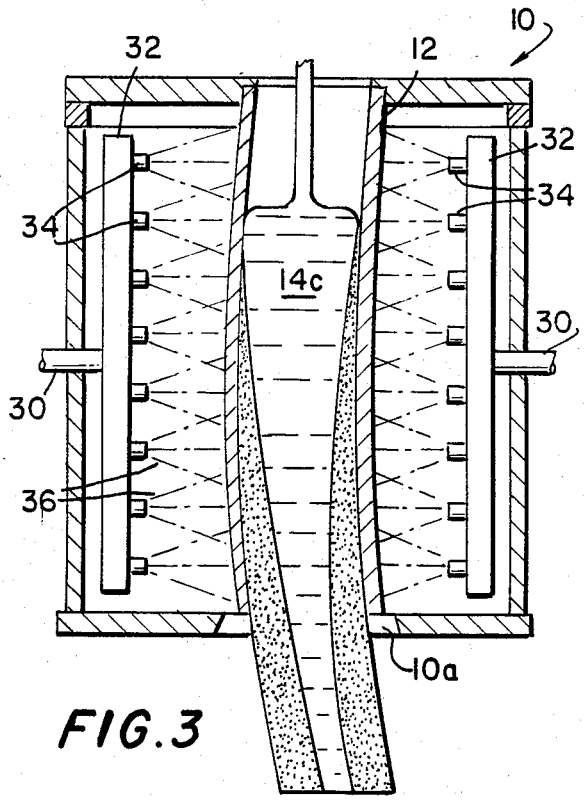
FIG. 3 depicts the illustrative embodiment of the present invention and is to be contrasted with the prior art system of FIG. 2.

FIG. 3 is a view similar to that of FIG. 2, but depicts the general principles of my invention. The critical parameters will be discussed below, but for the moment it should be noted that instead of a baffle jacket 20, several spray pipes 32 are provided. Water is supplied to these pipes via inlets 30, and water exits the pipes through nozzles 34 to form sprays 36. The sprays are directed to tube 12. The tube is not connected to the frame at the bottom, the numeral **10*a*** depicting a hole in the bottom of the frame through which the steel strand is withdrawn and above which the mold tube simply hangs; this "loose" construction, that is, the use of a non-pressure-tight vessel, allows for rapid replacement of mold tubes.

As will become apparent below, steam does form around the tube as it is sprayed with water. However, with the proper selection of operating parameters, the water spray effectively pushes the steam barrier aside so that the spray can penetrate the steam barrier which would otherwise block it. Once the water strikes the copper tube, some of it is converted to steam; but it is pushed aside and also partially condensed by the continuing spray. Also, much of the water spray simply bounces off the copper tube and is collected at the bottom of frame 10 (not shown) or even allowed to dip down around the solidifying strand.

One of the significant advantages of the system of FIG. 3 is that the sprays may be individually tailored to control a varying degree of heat extraction along the copper tube. By controlling the heat extraction in this manner, the expansion and contraction of the shell which is formed within the tube can be minimized. As shown in FIG. 3, the shell remains in intimate contact with the interior wall of the copper tube at all times. Because of this continuous contact, the thickness of the shell is greater at the mold exit, assuming the same rate of production for the two systems of FIGS. 2 and 3. Alternatively, the same shell thickness can result in the system of FIG. 3 with a faster rate of production.

In any particular system, the individual sprays may be controlled by changing nozzles, each nozzle allowing a different flow rate through it. The selection of nozzle sizes is empirical, but in general the flow rates of any two successive nozzles, from top to bottom, either remain the same or decrease. In other words, if a plot is made of nozzle flow rate versus nozzle, in a nozzle direction from top to bottom, the flow rate would remain constant from nozzle to nozzle or would decrease. Although the selection of nozzle sizes to maximize through-put has not been reduced to a formula, in general the nozzle flow rates should be selected such that the shell of the strand remains in maximum contact with the interior of the mold tube, as depicted in FIG. 3.

It is also contemplated that the precise control of heat extraction rate along the mold tube will affect the grade of the strand which is cast depending upon end-product requirements; for example, it may be possible to control the grain size and surface quality. From early experimentation it has been determined that the severity and depth of mold oscillation marks can be reduced and the zone of equiaxed grain growth can be increased, both of significant importance to the steel producer.

Figure 4:
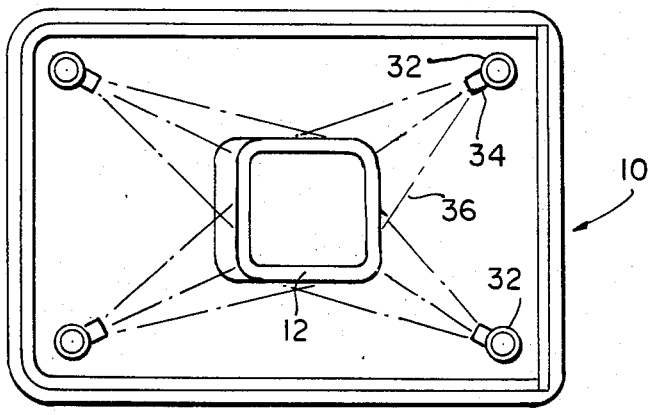
FIG. 4 is a top view of the apparatus of FIG. 3.

FIG. 4 is a top view of the system of FIG. 3, and it shows the mold being sprayed at its four corners. Although it is feasible to spray the faces of the mold, there are advantages in spraying the corners. The rapid formation of a solid shell is important to the success of the continuous casting process, because the shell supports the interior liquid steel and prevents strand breakout, and the strongest shell can be formed for any given casting speed by concentrating the cooling spray on the corners of the mold. It has been found that with the same size molds as used in the prior art, and for the same casting speeds, the emerging strand not only has a thicker shell, but its temperature is only about 1950° F., as opposed to 2150° F., when a conventional mold is used. The strand is thus stronger and exhibits a more uniform temperature profile.

Figure 5:
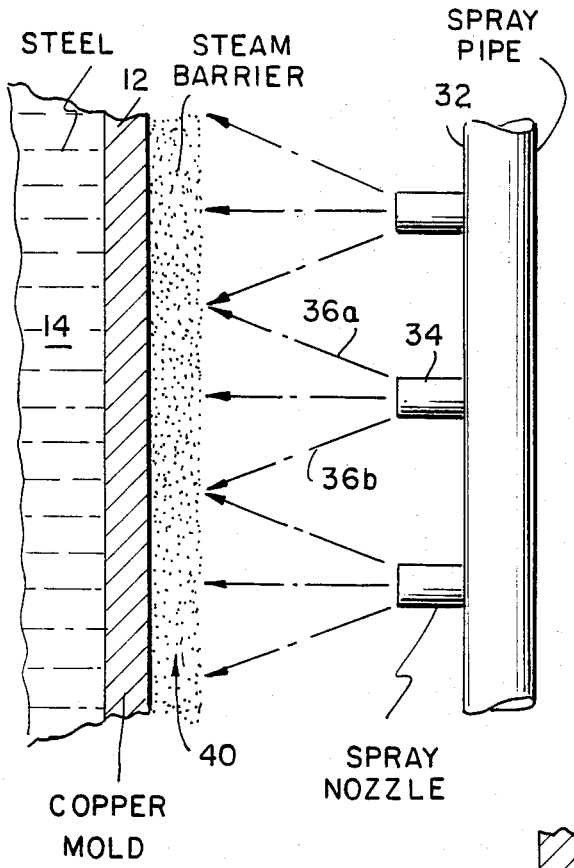
FIG. 5 is an enlarged view of a portion of the apparatus of FIG. 3, shows the spray nozzles being disposed at the maximum distance from the copper mold tube, and also depicts the nature of the steam barrier referred to above.
Figure 6:
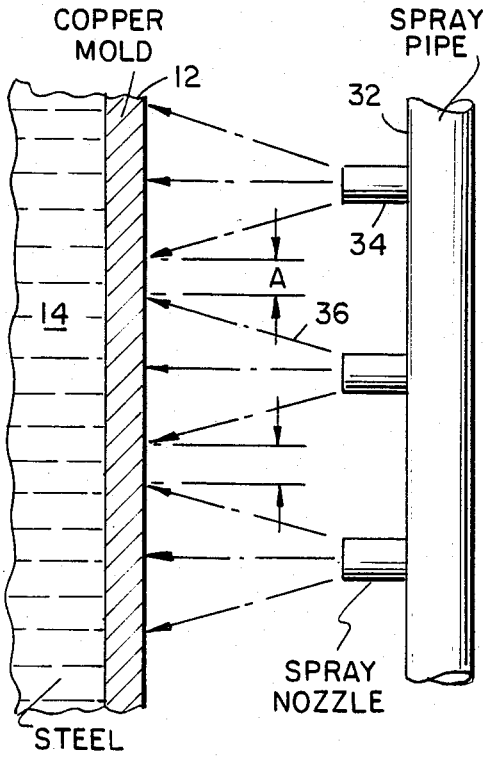
FIG. 6 depicts the preferred positioning of the spray nozzles relative to the mold tube and will also be helpful in understanding references below to the individual spray overlaps.
Figure 6A:
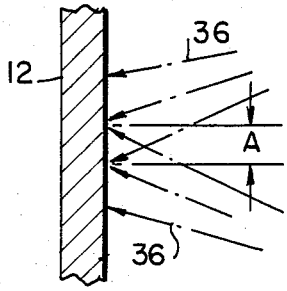
FIG. 6A will be further helpful in understanding what is meant by spray overlaps.

FIGS. 5, 6 and 6A depict certain critical parameters in accordance with the principles of my invention, wherein the molten metal in tube 12 is indicated generally at 14. At this point, reference might be made first to the Ennor et al patent referred to above. The drawings in that patent reveal that the spray coverage of the mold is not complete and there are large areas of the mold surface which are not sprayed. Water running down along the surface of the mold at the un-sprayed regions does not possess sufficient velocity to sweep away the steam barrier which is generated. The Ennor et al design cannot be used to cast steel because it would result in a mold meltdown. In fact, Ennor et al did not contemplate the casting of high melting-point metals and alloys. It is only with low melting-point alloys such as aluminum that those skilled in the art thought a spray system was practical.

The first critical parameter pertains to the distance between nozzles 34 and mold tube 12. Distances below 1" are preferred (a distance of ⅝" is shown in FIG. 6) although, in general, the distance may be as great as 6", but no greater, as shown in FIG. 5. While it may be possible to place the nozzles more than 6" away from the mold tube, to ensure that the spray cooling water possesses sufficient velocity to penetrate the steam barrier with machines of present-day sizes and with conventional water pumping systems, the distance should not exceed 6".

The second parameter of interest is the spray angle of each nozzle, that is, the angle formed by the conically-shaped spray on a plane passed through the cone axis. The angle between lines **36*a* and 36*b* in FIG. 5 should be no greater than 110°. If a spray angle greater than 110° is utilized, the outer reaches of the water spray do not possess a sufficient velocity component perpendicular to the steam barrier and cannot penetrate the barrier. The steam barrier is depicted symbolically by the numeral 40** in FIG. 5. Although the central part of each spray can penetrate the barrier even with a larger spray angle, the water at the outer reaches of each conically-shaped spray might not penetrate the barrier and the region of the copper tube which might thus not be cooled could result in a melt-down. In general, a spray angle of about 80° is preferred. If the spray angle is less than 65°, the nozzles must be mounted very close to each other to effect correct spray coverage and this would require a more complex design.

The third parameter of importance is the spray overlap on the mold. FIG. 6 depicts a distance A between sprays, where the sprays strike the copper tube 12. This can be thought of as a "negative" overlap, a negative overlap being a separation. The maximum separation must be limited to one inch or else there will be a danger of a tube melt-down. Where the sprays actually overlap, as depicted in FIG. 6A, the overlap should be kept to less than one inch. It has been found that if there is a greater overlap, the water sprays interfere with each other and the resulting spray velocities are not sufficient to penetrate the steam barrier. While the overlap range is thus −1 to +1 inch, the preferred range is 0–0.5".

Another parameter of importance is the spacing between nozzles. In one embodiment of the invention, the nozzles were spaced 2.25" apart. In any practical system, the nozzle spacing is determined by the nozzle-to-mold distance, the spray angle and the spray overlap parameters.

One system constructed in accordance with the principles of the invention was provided with a standard water pumping system which delivered 150–500 gallons per minute of cooling water for a standard-size 32" mold length. The gauge pressure at the nozzle exits could be anywhere in the range of 40–150 pounds per square inch.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A continuous casting machine for casting metals whose melting point temperature is in excess of about 2,600° F., comprising: a frame having a top and a bottom; a vertically oriented mold tube positioned in and secured to the top of said frame; and spray means including a plurality of spray nozzles spaced around said mold tube for directing sprays of water against the exterior surface of the mold tube to cool molten metal therein; said spray means and spray nozzles being constructed and arranged to cause said sprays of water upon exit from the spray nozzles to have a gauge pressure in the range of from about 40 pounds per square inch to about 150 pounds per square inch and to have an included spray angle of up to about 110°; and said spray nozzles being spaced up to about six inches from the mold tube and from each other a predetermined distance such that adjacent sprays of water, where they strike the mold tube, do not overlap each other more than about one inch and are not spaced from each other more than about one inch, whereby the sprays of water dissipate any barrier or layer of steam which tends to form around said mold tube and at the same time effect cooling of the molten metal in the mold tube.

2. A continuous casting machine in accordance with claim 1, wherein said mold tube hangs loose at the bottom of said frame.

3. A continuous casting machine in accordance with claim 2, wherein the included angle of each spray is greater than about 65 degrees.

4. A continuous casting machine in accordance with claim 3, wherein the tip of each nozzle is spaced from the exterior of said mold tube by less than about one inch.

5. A continuous casting machine in accordance with claim 4, wherein adjacent sprays in the vertical direction, where they strike the exterior of said mold tube, overlap each other by no more than about one-half inch.

6. A continuous casting machine in accordance with claim 5, wherein the water flow rate for each 32 inches of mold length is in the range of 150–500 gallons per minute.

7. A continuous casting machine in accordance with claim 2, wherein the tip of each nozzle is spaced from the exterior of said mold tube by less than one inch.

8. A continuous casting machinee in accordance with claim 2, wherein adjacent sprays in the vertical direction, where they strike the exterior of said mold tube, overlap each other by no more than about one-half inch.

9. A continuous casting machine in accordance with claim 2, wherein the water flow rate for each 32 inches of mold length is in the range of 150–500 gallons per minute.

10. A continuous casting machine in accordance with claim 1, wherein the angle of each spray is greater than about 65 degrees.

11. A continuous casting machine in accordance with claim 1, wherein the tip of each nozzle is spaced from the exterior of said mold tube by less than about one inch.

12. A continuous casting machine in accordance with claim 1, wherein adjacent sprays in the vertical direction, where they strike the exterior of said mold tube, overlap each other by no more than about one-half inch.

13. A continuous casting machine in accordance with claim 1, wherein the water flow rate for each 32 inches of mold length is in the range of 150–500 gallons per minute.

14. A continuous casting machine for casting metals whose melting point temperature is in excess of about 2,600° F., comprising: a frame having a top and a bottom; a vertically oriented mold tube positioned in and secured to the top of the frame; and a plurality of spray means supported in said frame in predetermined spaced relationship to the mold tube and to each other to direct sprays of water against the exterior surface of said mold tube all around its circumference such that said sprays of water do not overlap by more than about one inch and are not spaced from one another by more than about one inch in the vertical direction where the sprays strike the mold tube, and said sprays of water have a predetermined included spray angle and a gauge pressure upon exit from the spray means such that said water sprays dissipate any steam barrier or layer which tends to form around said mold tube and at the same time effect cooling of molten metal in the mold tube.

15. A continuous casting machine in accordance with claim 14, wherein the gauge pressure of the water spray at the exit of each nozzle is in the range of 40–150 pounds per square inch.

16. A continuous casting machine in accordance with claim 14, wherein the gauge pressure of the water spray at the exit of each nozzle is in the range of 40–150 pounds per square inch.

* * * * *